United States Patent [19]

Lates

[11] Patent Number: 4,597,503

[45] Date of Patent: Jul. 1, 1986

[54] UNITARY MOLDED CITRUS CRATE

[75] Inventor: Kornel Lates, Thornhill, Canada

[73] Assignee: Scepter Manufacturing Co. Ltd., Toronto, Canada

[21] Appl. No.: 683,916

[22] Filed: Dec. 18, 1984

[51] Int. Cl.[4] ..... B65D 1/38; B65D 1/42

[52] U.S. Cl. ..... 220/83; 217/40; 220/72; 220/DIG. 15

[58] Field of Search ..... 220/72, 87, DIG. 15; 217/40, 42; 264/328.9, 318, 324, 304, DIG. 70; 206/509, 521, 557

[56] References Cited

U.S. PATENT DOCUMENTS

| | | | |
|---|---|---|---|
| 3,092,284 | 6/1963 | Stout | 220/21 |
| 3,307,729 | 3/1967 | Schwartz | 220/72 X |
| 3,311,257 | 3/1967 | Puente | 220/72 X |
| 3,521,808 | 7/1970 | Weiss | 220/72 X |
| 3,549,018 | 12/1970 | Wilson | 206/509 |
| 3,565,278 | 2/1971 | Rehrig | 220/21 |
| 3,655,114 | 4/1972 | Turner | 217/42 |
| 3,687,330 | 8/1972 | Herolzer | 220/83 X |
| 3,905,510 | 9/1975 | Johnson | 220/72 X |
| 3,957,944 | 5/1976 | Guala | 264/318 X |
| 4,123,495 | 10/1978 | Abey | 264/318 |
| 4,201,360 | 5/1980 | Schwartzburg et al. | 264/318 X |
| 4,249,671 | 2/1981 | Crolli | 220/DIG. 15 |

FOREIGN PATENT DOCUMENTS

| | | | |
|---|---|---|---|
| 263632 | 10/1967 | Austria | 220/21 |
| 650819 | 10/1962 | Canada | 270/72 |
| 704377 | 4/1966 | Italy | 220/72 |

*Primary Examiner*—Allan N. Shoap

*Attorney, Agent, or Firm*—Blakely, Sokoloff, Taylor & Zafman

[57] ABSTRACT

A unitary molded citrus crate ideally suited for the storage and transport of citrus is disclosed. The citrus crate is specifically configured to provide a combination of flat and convex surfaces in the internal fruit holding portion to prevent damage to the fruit therein to the maximum extent possible. A center divider is provided to prevent separation of the side walls of the crate, the center divider having sufficient height so no more than one fruit such as a lemon or the like may rest thereon, thereby preventing sufficient force between the fruit and the top of the divider to damage the fruit because of the weight of the fruit stacked thereon. Horizontal openings in the side and end wall provide ease of handling of the crate, the openings being of limited height adequate to provide convenient hand grasps yet sufficiently limited to prevent damage to the fruit. The crates are stackable in an interlocking stack to prevent tipping thereof. Various other features of the invention are also disclosed.

3 Claims, 4 Drawing Figures

UNITARY MOLDED CITRUS CRATE

BACKGROUND OF THE INVENTION

1. Field of the Invention

The present invention relates to the field of citrus crates.

2. Prior Art

Certain citrus, particularly lemons, are prepared for storage and then stored in crates for substantial periods of time of up to six months prior to being shipped for retail sale in order to substantially extend the apparent season for the fruit. Historically, wooden crates have been used for this purpose, such crates being rectangular in shape and usually having solid endwalls and center divider with slatted sides and bottom. While wood generally works well for such purpose, such crates have become increasingly expensive in recent years because of the increasing cost of wood and the amount of hand labor in the fabrication of such crates, and further for the reason that such crates tend to deteriorate with use and abuse, typically requiring replacement thereof after perhaps a couple of seasons of use.

In order to reduce the overall costs of such crates in part by extending the useful life thereof, plastic crates have been designed and fabricated to replace the prior art wooden crate. One such prior art plastic crate is a crate manufactured by Republic Tool and Manufacturing Corp. and distributed by Fruit Growers Supply Co., Sherman Oaks, Calif. This crate, of one piece molded plastic construction, is of substantially the same size as prior art wooden crates. The plastic crate has a bottom surface having a plurality of slots therein, and integral side and end walls comprising vertical slat-like members, each approximately one and one-half inches wide, spaced from the adjacent members by approximately one inch. The corner members of the plastic crate are slightly wider, having a radius at the corner turn itself of perhaps approximately one-half an inch, that radius being terminated at the edge of the corner "slat" at the end of the crate with a substantially smaller convex radius. The interior of the crate is divided into three identifiable regions of approximately equal size, defined by a short divider between each of the regions extending upward from the bottom of the crate by approximately one inch, with hollow inwardly projecting vertical side ribs joining the edges of each of the two dividers and extending upward to a region adjacent the top of the crate to aid in the support of a crate piled there above.

The foregoing prior art plastic crate is a substantial and durable article and in terms of usable life, should achieve one desired aspect of such articles, specifically repeated use before replacement is required. However, such crates have certain characteristics which are substantially less than ideal in use. In particular, the two very short "dividers" allows lemons to be placed directly thereover with additional lemons thereabove, forcing the lower lemons directly against the top of the narrow divider, with the result that the relatively small radius at the top of the dividers frequently seriously bruise the lemons so as to require the discarding of those lemons at the time of fruit preparation for shipment for retail sales. Further, the damaging of one or more lemons in a crate may well cause spoilage of that lemon as well as adjacent lemons over a period of time, so that spoilage of a large part of a crate may well occur. In addition, the short dividers themselves do not provide any substantial resistance to the spreading of the crate sidewalls but instead, such spreading is inhibited at least in part by the vertical ribs hereinbefore described. These ribs themselves, while being radiused, are sufficiently convex to at least on occasion damage the fruit, depending upon how hard the fruit is wedged thereagainst, the firmness of the particular fruit, etc. In that regard the spreading of the sidewalls would appear to be inhibited at least in part by the overall thickness of the material used, particularly the top encircling rim of the crate, resulting in a crate which is heavier than necessary, and more costly than necessary because of the extra plastic used. In that regard, at least many of the surfaces of the crate, including some fruit engaging surfaces, are relatively rough, and while themselves not likely to damage the fruit because of the roughness thereof, will entrap juice and other organic material to which it may be exposed during use, thereby promoting bacterial growth unless carefully cleaned between uses thereof. Finally, while the vertical slats at the end walls of the prior art crate are interconnected with horizontal members between which a person's finger may pass for handling of the crates, such handling is awkward and inconvenient as there is room for only one finger in each opening, with "adjacent" opening being a full two and one-half inches apart. This makes handling cumbersome when empty and even more difficult when the crate is full, as the relatively narrow cross members provide very little area on which the crate must be lifted by typically no more than two fingers of each hand.

BRIEF SUMMARY OF THE INVENTION

A unitary molded citrus crate ideally suited for the storage and transport of citrus is disclosed. The citrus crate is specifically configured to provide a combination of flat and convex surfaces in the internal fruit holding portion to prevent damage to the fruit therein to the maximum extent possible. A center divider is provided to prevent separation of the side walls of the crate, the center divider having sufficient height so no more than one fruit such as a lemon or the like may rest thereon, thereby preventing sufficient force between the fruit and the top of the divider to damage the fruit because of the weight of the fruit stacked thereon. Horizontal openings in the side and end wall provide ease of handling of the crate, the openings being of limited height adequate to provide convenient hand grasps yet sufficiently limited to prevent damage to the fruit. The crates are stackable in an interlocking stack to prevent tipping thereof. Various other features of the invention are also disclosed.

DETAILED DESCRIPTION OF THE INVENTION

Figure 1:
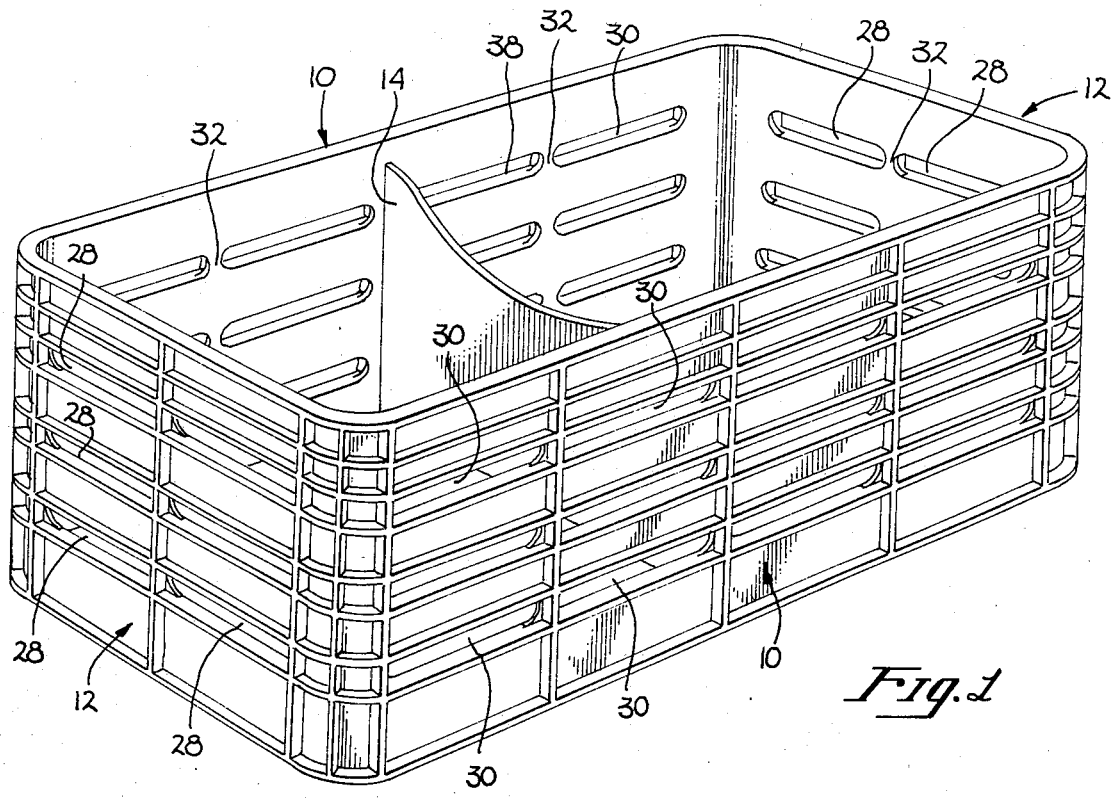
FIG. 1 is a perspective view of the preferred embodiment of the present invention.

First referring to FIG. 1, a top view of the plastic crate of the present invention may be seen. As illustrated, the crate is of one piece molded plastic, preferably a high density polyethylene, being comprised of sidewalls generally indicated by the numeral 10, end walls generally indicated by the numeral 12, a bottom panel not visible in FIG. 1 and a single central divider 14. The divider 14 is a relatively thin divider serving primarily to prevent the spreading of the relatively long sidewalls 10 due to the pressure of the citrus therein. The divider is a relatively tall divider, rising to within approximately two and one/half inches from the top of the crate. Such height allows the stacking of one lemon thereon, the weight of which is inadequate to cause the divider to bruise the lemon in any way, though does not allow the stacking of additional lemons thereabove to result in sufficient force to result in such damage.

Figure 2:
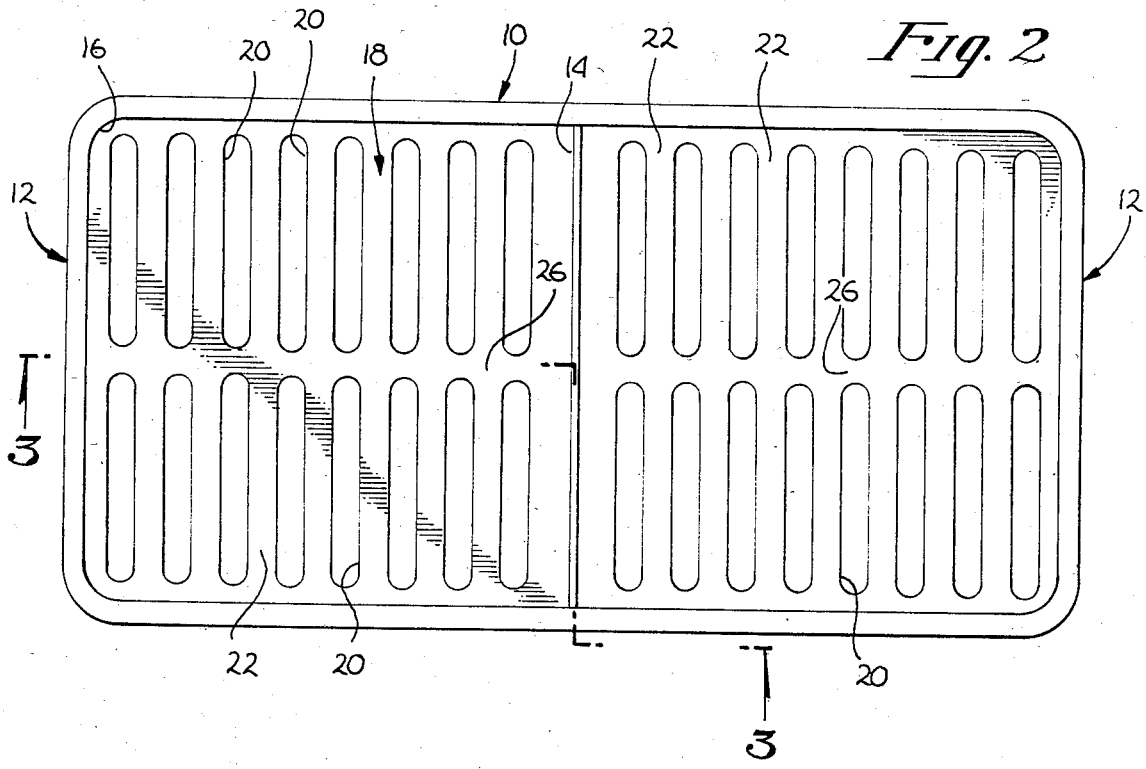
FIG. 2 is a top view of the crate of FIG. 1.
Figure 3:
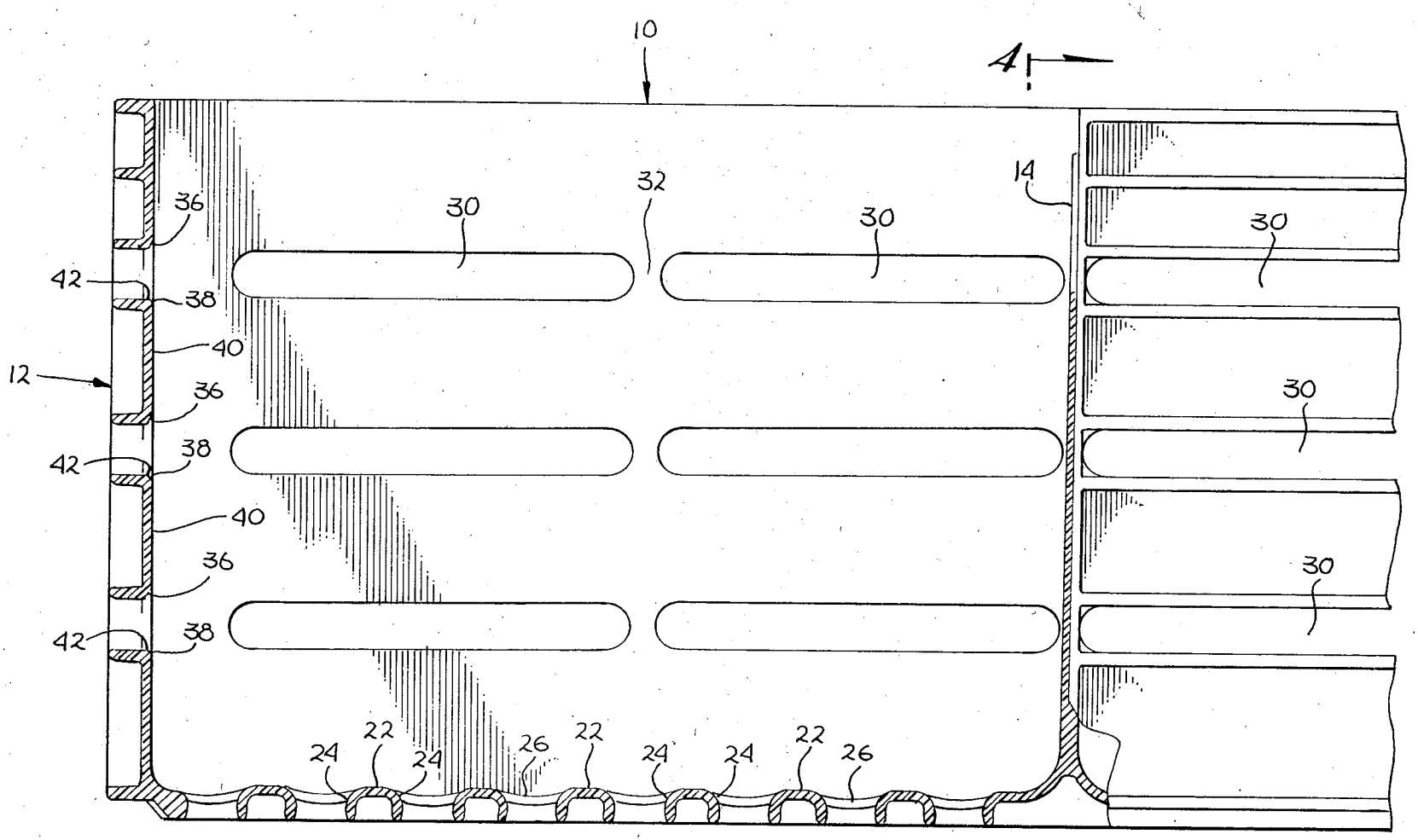
FIG. 3 is a partial cross section taken along line 3—3 of FIG. 2.

The interior of the crate as defined by the side and end walls 10 and 12 is substantially smooth, being generally rectangular in shape and having a generous radius of curvature at the corners 16 thereof, more specifically in the preferred embodiment, a radius of approximately one inch to smoothly join the inner surfaces of the side and end walls. Also, as may be seen in FIG. 2, the bottom of the crate, generally indicated by the numeral 18, has a plurality of openings 20 therein arranged in two rows along the longitudinal direction of the crate, the openings facilitating the passage of juice therethrough and making the washing and drying of the crates between uses substantially easier. The two rows of openings essentially provide the appearance of a slatted bottom, with the slats tied together along the bottom line of the crate for increased rigidity and to cause any deflection of the crate bottom to be as a unitary piece rather than as individual members which could damage fruit in a filled crate. The configuration of the individual slats may be seen in FIG. 3, which is a partial cross section taken along line 3—3 of FIG. 2. It will be noted that each of the slats 22 has a generous radius at the edges thereof to provide a smooth surface free of any sharp edges on which the lemons will rest. In that regard, the parting line between the core defining the interior of the crate and the portion of the mold which defines the exterior surfaces of the bottom is approximately at points 24 in the preferred embodiment, so that any sharp edge would could appear at the parting line is below the elevation of the lemons within the crate so as to not normally contact the lemons therein during normal usage. Similarly, of course, region 26 coupling the individual slat-like members 22 along the center line of the crate are also curved in both directions to avoid any localized area of high pressure on the lemons therein.

Another unique aspect of the crate of the present invention are the horizontal slot-like openings in the side and end walls thereof. As may be seen in FIG. 1, the end walls have slot-like openings 28, with the side walls having similar slot-like openings 30. These openings in the preferred embodiment are approximately ¾ of an inch high, being separated from the adjacent such opening by relatively narrow divider members 32. In this way the openings, particularly the upper pair of openings at each end of the crate, provide convenient hand holds for handling the crate, whether full or empty, yet define an opening sufficiently narrow to contact lemons within the crate with a minimum local pressure. While the openings themselves could be of a different size, openings much under ¾ of an inch in height will not be convenient for the handling of the crate, and openings of more than 1 inch or so will be unnecessarily large and may contact the citrus in such a way as to possibly damage the same.

One very important aspect of the openings 28 and 30 in the end and sidewalls of the crate is the inner configuration thereof. In particular, the configuration of the slat-like members 22 in the bottom of the crate was previously described, it being pointed out therein that the parting line between the inner core and the corresponding outer portion of the mold is effectively below the inner surface of the crate so that any sharp edges which might occur in the crate at the parting line are below the elevation of the citrus within the crate. Normally however, one is limited with respect to the side and end walls of the crate as the central core defining the interior of the crate must be removed through the top of the crate, whereby the parting line between the central core and the portion of the mold defining the outer surfaces of the side and end walls and any openings therethrough must necessarily be in the plane of the inner surfaces of the side and end walls of the crate. This in turn would cause very sharp inner edges on the openings 28 and 30 which would have a strong tendency to cut into citrus resting thereon. In the prior art this problem was avoided or at least minimized by using a slat-like structure for the side and end walls whereby, with the slats having a vertical orientation, the slats could have a cross section similar to the slats in the bottom of the case of the present invention (See FIG. 3) and still be definable by a plug readily withdrawable vertically out of the crate. The difficulty with that configuration however, is that the vertical slats reduce the horizontal width of any openings therebetween to an amount accepting only one or two fingers of the person handling the crate, making the handling thereof much more difficult than in the present invention.

Figure 4:
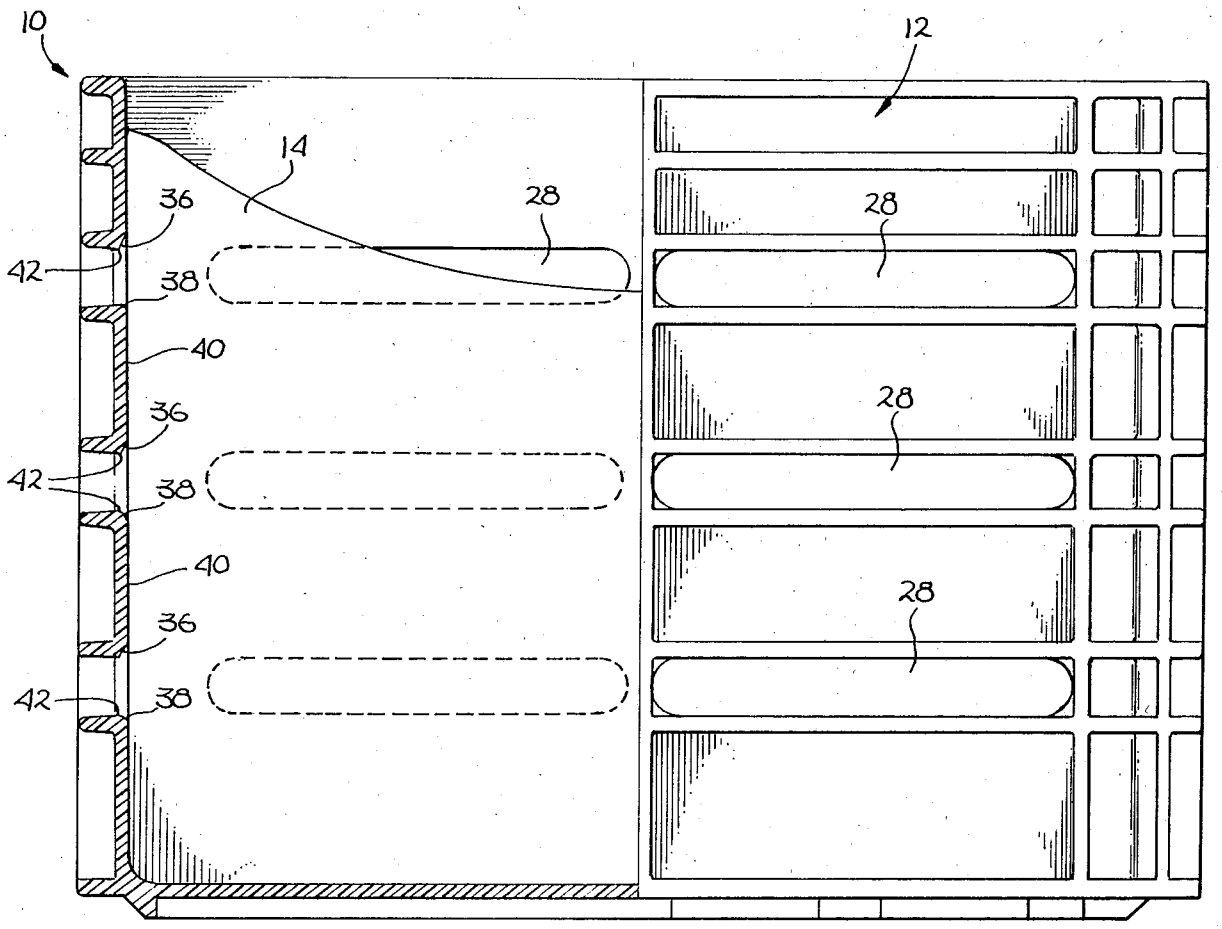
FIG. 4 is a partial cross section taken along line 4—4 of FIG. 3

In the present invention, the openings 28 and 30 in the end and sidewalls are defined by a central core in the mold having slight projections in the region of each opening. These projections, of course, are complimentary to the finished interior of the crate as may be seen in the partial cross sections of FIGS. 3 and 4. In particular, the central core of the mold projects outward somewhat at each opening so as to define a chamfer-like region 36 at the top of each opening, and to define a small radius 38 at the bottom of each opening. The net result is that the parting line between the core and the portion of the mold defining the outer surfaces of the side and end walls and the openings therein is not flush with surfaces 40 of the side and end walls, but rather is recessed within the openings at approximately region 42. Consequently, any sharp edge which could result at the location of the parting line is recessed into the openings by an amount preventing the contact of the citrus therewith. The central core of the mold may be readily withdrawn however, as the chamferred regions 36 encourage a slight spreading of the side and end walls upon withdrawal of the core to provide the required clearance.

Thus the present invention provides a crate having a generally horizontal and slatted side and end wall structure to provide horizontal slots for the convenient handling of the crate, yet avoids sharp edges on or coplanar with the inner walls of the crate to avoid any possible cutting and deterioration of citrus stored therein as a result thereof. Preferably all surfaces of the crate are smooth to avoid abrasion on the citrus and to facilitate cleaning between uses. Obviously, while the preferred embodiment has been disclosed and described herein, it will be understood by those skilled in the art that various changes in form and detail may be made therein without departing from the spirit and scope of the invention.

I claim:

1. A one piece molded citrus crate comprising first and second substantially parallel sidewalls, first and second substantially parallel end walls and a bottom, said first and second sidewall, said first and second end walls and said bottom being integrally connected at the edges thereof to define an open top rectangular crate-like structure, said bottom being slotted so as to define a plurality of interconnected slat-like members, said slat-like members having a smooth convex curvature adjacent the edges thereof adjacent the interior of the crate, said first and second end walls each also having at least one horizontal slot therethrough proportioned to form a convenient hand hold, the edges of said horizontal slot of each of said first and second end walls facing the interior of said crate being bevelled such that the edges forming the slot are recessed into said slot to a mold parting line within said slot, whereby the interior of said crate is free of sharp edges in the interior thereof contactable in normal use by citrus stored therein, and wherein the edge of each of said horizontal slots closer to the open top of said crate is recessed by a substantially flat chamfer thereon.

2. The one piece molded citrus crate of claim 1 wherein each of said end walls has a pair of said horizontal slots adjacent the top thereof, separated by a relatively narrow interconnecting member, whereby a person may hold the crate by the ends thereof with said interconnecting members disposed between the person's fingers.

3. The one piece molded citrus crate of claim 1 wherein said side and end walls of said crate have a plurality of said horizontal slots disposed at different elevations.

* * * * *